US009070238B2

(12) United States Patent
Karlsson et al.

(10) Patent No.: US 9,070,238 B2
(45) Date of Patent: Jun. 30, 2015

(54) MODULE AND APPARATUS

(71) Applicant: Scan Coin AB, Malmo (SE)

(72) Inventors: Jerry Karlsson, Lund (SE); Peter Gillstedt, Loddekopinge (SE); Markus Jonasson, Malmo (SE); Robert Gustavsson, Lund (SE)

(73) Assignee: Scan Coin AB, Malmo (SE)

( * ) Notice: Subject to any disclaimer, the term of this patent is extended or adjusted under 35 U.S.C. 154(b) by 0 days.

(21) Appl. No.: 14/224,481

(22) Filed: Mar. 25, 2014

(65) Prior Publication Data

US 2014/0295745 A1 Oct. 2, 2014

(30) Foreign Application Priority Data

Mar. 28, 2013 (EP) ..... 13161528

(51) Int. Cl.

| | |
|---|---|
| ***G07D 3/06*** | (2006.01) |
| ***G07D 9/00*** | (2006.01) |
| ***G07F 1/04*** | (2006.01) |
| *G07D 3/14* | (2006.01) |

(52) U.S. Cl.

CPC .. *G07D 3/06* (2013.01); *G07D 3/14* (2013.01); *G07D 9/008* (2013.01); *G07F 1/048* (2013.01)

(58) Field of Classification Search

CPC ..... G07D 3/06; G07D 3/14
USPC ..... 453/9, 12, 49, 57; 194/344
See application file for complete search history.

(56) References Cited

U.S. PATENT DOCUMENTS

| | | | | | |
|---|---|---|---|---|---|
| 3,978,962 | A | * | 9/1976 | Gregory, Jr. | 194/328 |
| 4,059,122 | A | * | 11/1977 | Kinoshita | 453/3 |
| 4,943,258 | A | | 7/1990 | Abe | |
| 4,988,860 | A | * | 1/1991 | Wollet et al. | 250/223 R |
| 5,240,099 | A | * | 8/1993 | Brown et al. | 194/317 |
| 5,382,191 | A | | 1/1995 | Rasmussen | |
| 6,138,813 | A | * | 10/2000 | Lamb et al. | 194/317 |
| 6,168,001 | B1 | | 1/2001 | Davis | |
| 6,350,193 | B1 | * | 2/2002 | Paulsen | 453/57 |
| 6,679,770 | B1 | | 1/2004 | Sugai et al. | |
| 7,490,709 | B2 | | 2/2009 | Jönsson | |

(Continued)

FOREIGN PATENT DOCUMENTS

| | | | |
|---|---|---|---|
| CN | 201331787 Y | 10/2009 | G07D 9/00 |
| DE | 10 2010 049 208 A1 | 4/2012 | G07D 3/16 |

(Continued)

OTHER PUBLICATIONS

European Search Report Dated Sep. 12, 2013, for co-pending European Patent Application No. 13161542.9, (8 pages).

(Continued)

*Primary Examiner* — Mark Beauchaine
(74) *Attorney, Agent, or Firm* — Womble Carlyle Sandridge & Rice, LLP

(57) ABSTRACT

The present disclosure provides a coin counting and sorting module comprising: a coin sorter; a coin bowl having an inner surface comprising a rotating surface adapted for being rotated when the module is in operation; a coin sensor for detecting and removing counterfeit coins; a coin separating rail knife for receiving coins one by one; an inclined rail block; and an anti-bounce block rigidly fastened to the inclined rail block by a finite number of fastening elements. This disclosure also provides a coin handling apparatus comprising such a coin counting and sorting module.

17 Claims, 4 Drawing Sheets

(56) References Cited

U.S. PATENT DOCUMENTS

| | | | | |
|---|---|---|---|---|
| 7,658,668 | B2 | 2/2010 | Hill | |
| 8,202,144 | B2 * | 6/2012 | Hino et al. | 453/6 |
| 2009/0305620 | A1 | 12/2009 | Hino et al. | |
| 2013/0277177 | A1 | 10/2013 | Kuesel | |

FOREIGN PATENT DOCUMENTS

| | | | |
|---|---|---|---|
| EP | 0 469 886 | 8/1990 | G07D 1/00 |
| EP | 0 950 989 | 10/1999 | G07D 9/00 |
| WO | WO 94/23397 | 10/1994 | G07D 3/00 |
| WO | WO 97/05581 | 2/1997 | G07D 9/00 |
| WO | WO 97/07485 | 2/1997 | G07D 3/06 |
| WO | WO 99/33030 | 7/1999 | G07D 3/00 |
| WO | WO 03/049049 | 6/2003 | G07D 9/00 |
| WO | WO 2008/024043 | 2/2008 | G07D 9/00 |

OTHER PUBLICATIONS

European Search Report Dated Sep. 13, 2013, for co-pending European Patent Application No. 13161528.8, (8 pages).

* cited by examiner

MODULE AND APPARATUS

CROSS-REFERENCE TO RELATED APPLICATIONS

This application claims the benefit of European Patent Application No. 13161528.8, filed on Mar. 28, 2013.

INCORPORATION BY REFERENCE

The entire disclosure of European Patent Application No. 13161528.8, filed on Mar. 28, 2013, is incorporated herein by reference as if set forth in its entirety.

TECHNICAL FIELD

The present invention relates to the field of cash handling. More specifically, the invention relates to a module for counting and sorting a plurality of coins. The invention further provides a cash handling apparatus comprising such a module.

BACKGROUND OF THE INVENTION

Retail cash systems (RCS) are used for handling of cash, such as notes (bills), cheques or coupons in a retail establishment. The systems generally comprise a coin deposit apparatus and a coin dispensing apparatus.

The coin deposit apparatus has to discriminate between different types of acceptable coins, such as valid coins in a plurality of denominations in one or more specific currencies. Preferably, it should also be capable of detecting unacceptable cash, such as fake (counterfeit) coins or coins of a foreign currency. In the coin deposit apparatus a coin acceptance module (CAM) handles the discrimination of coins and is also adapted to count the coins to register the deposited amount. One typical user is a cashier emptying a till after a work shift.

A typical CAM is disclosed in WO 2008/024043. This CAM is comprised of a hopper bowl comprising a rotary flexible disc. Coins fed into the hopper bowl are picked up by the rotary flexible disc and fed via a sorting knife to a downwardly sloping coin rail mounted to a backwardly inclined front plate of the CAM. Ideally, each coin rolls by gravity down the coin rail past a coin sensor unit for removing counterfeit coins down to a coin sorter comprising a rotary carrier disc. This carrier disc transports valid coins along a circular sorting path across a series of openings in the front plate. The openings are of increasing size, such that coins of the smallest diameter will fall down through the first opening in the transport direction, whereas coins of the second smallest opening are separated through the next opening, etc.

However, it turns out that some coins do not roll smoothly down the coin rail. In fact, they may start bouncing along the way. As a result, the bouncing coins may reach the carrier disc at a distance from the circular sorting path, which in turn may lead to poor sorting of these bouncing coins.

Accordingly there is a need for improved ways of sorting coins.

SUMMARY

In view of the above, an objective of this disclosure is to solve or at least reduce one or several of the drawbacks discussed above. Generally, the above objective is achieved by the attached independent patent claims.

A first aspect of this disclosure is the provision of a coin counting and sorting module comprising a coin sorter wherein coins to be sorted are transported by a rotary disc along a circular sorting path across a series of openings of increasing size;

a coin bowl for receiving a mass of coins to be sorted, said coin bowl having an inner surface intended to be in contact with the coins to be sorted, the inner surface comprising a rotating surface adapted for being rotated when the module is in operation;

a front coin sensor for detecting and removing counterfeit coins;

a coin-separating rail knife for receiving coins one by one at a first end thereof from the rotating surface, and for guiding the coins past the front coin sensor;

the coin sorter, the coin bowl, the front coin sensor, and the coin-separating rail knife being mounted on a front plate of the coin counting and sorting module, wherein the coin counting and sorting module also comprises an inclined rail block for receiving accepted coins from the second end of the coin-separating rail knife and forwarding these coins to the coin sorter, said inclined rail block being mounted on the front plate of the coin counting and sorting module, and where an anti-bounce block is firmly fastened to the inclined rail block by a finite number of fastening elements.

As disclosed herein, the term "coin sorter" relates to a sorter of a type where coins to be sorted are transported by a rotary disc along a circular sorting path across a series of openings of increasing size. An example of a coin sorter of this type is disclosed in WO 2008/024043.

As disclosed herein, the term "coin bowl" relates to a bowl-shaped structure for receiving a plurality of coins to be sorted. A rotating surface within the bowl guides coins to a rail knife. Examples of such a coin bowl could be found in WO 97/07485 and WO 2008/024043.

As disclosed herein, the term "front coin sensor" relates to a sensor for detecting physical parameters of a passing coin, such as conductivity, permeability, diameter and thickness.

As disclosed herein, the term "coin-separating rail knife" relates to an elongated rail structure adapted for capturing coins in a coin bowl and guiding them further. Such knives and rails are known and examples are disclosed in WO 97/07485 and WO 2008/024043.

According to one embodiment, the anti-bounce block is rectangular in a front view.

According to one embodiment, the anti-bounce block has a length within the range of 50-100 mm and a height within the range of 5-20 mm.

According to one embodiment, the inclined rail block has an angled end part adapted for guiding coins one by one from the plane of the coin separating rail knife to the plane of the coin sorter.

According to one embodiment, the inclination of the angled end part of the inclined rail block amounts to a value comprised within the range from and including 1° up to and including 15° in relation to the plane of the sorting rail knife.

According to one embodiment, the finite number of fastening elements for firmly fastening the anti-bounce block is 2 or 3.

According to one embodiment, the overall shape of the anti-bounce block is a substantially rectangular parallelepiped.

According to one embodiment, there are elevated regions on the surface of the anti-bounce block that is adapted to be facing away from the inclined rail block in vicinity of openings for receiving fastening elements.

In an alternative embodiment of the first aspect of this disclosure, the anti-bounce block is substantially wedge-shaped.

According to one embodiment, the anti-bounce block is made entirely of metal. The term "metal" is intended to encompass ordinary metals used in engineering industry, such as steel, stainless steel, brass and cast iron. The inclined rail block (20) is also, according to one embodiment, made entirely of metal.

According to one embodiment, said fastening elements are selected from the group of bolts, screws and nuts and other similar elements for joining metal pieces.

A second aspect of this disclosure is a coin handling apparatus comprising a coin counting and sorting module (10) in accordance with claims 1-12. As disclosed herein, the term "coin handling apparatus" relates to any kind of coin handling apparatus adapted for sorting a mixture of coins into different denominations.

BRIEF DESCRIPTION OF THE FIGURES

The present disclosure will now be described with reference to the enclosed figures, in which.

DETAILED DESCRIPTION OF THE PRESENT DISCLOSURE

The present disclosure is focused on improving the performance of coin sorter having a circular sorting path across a series of openings of increased size, and where a coin to be sorted is transported along this sorting path. Such a module is often constructed such that the coin to be sorted is transported to the coin sorter on an inclined rail block. It may be advantageous if the inclined rail block is designed to deliver the transported coin to the coin sorter such that the resilient rim will engage the coin in good time before the first coin opening of the base plate. Consequently, the at least one protruding part of the resilient rim will have a certain distance available before the coin have to be pressured towards the border of the base plate, e.g. before the first coin opening. This may be advantageous if for example the coin is bouncing slightly just when the coin is grabbed by the rim. According to embodiments of the present invention, the resilient rim may engage the transported coin at coin at least 35 mm before the first coin opening which may reduce the miss sorting. In the case of the inclined rail block being mounted to the coin counting and sorting module in a plane behind the plane of the coin sorter, an angled end portion of the inclined rail block may be an simple and easy to manufacture solution to ensure that the resilient rim can engage the transported coin at the proper distance from the first coin opening.

The present disclosure will now be described more fully hereinafter with reference to the accompanying drawings. The invention may, however, be embodied in many different forms and should not be construed as limited to the embodiments set forth herein; rather, these embodiments are provided for thoroughness and completeness, and fully convey the scope of the invention to the skilled person.

Figure 1:
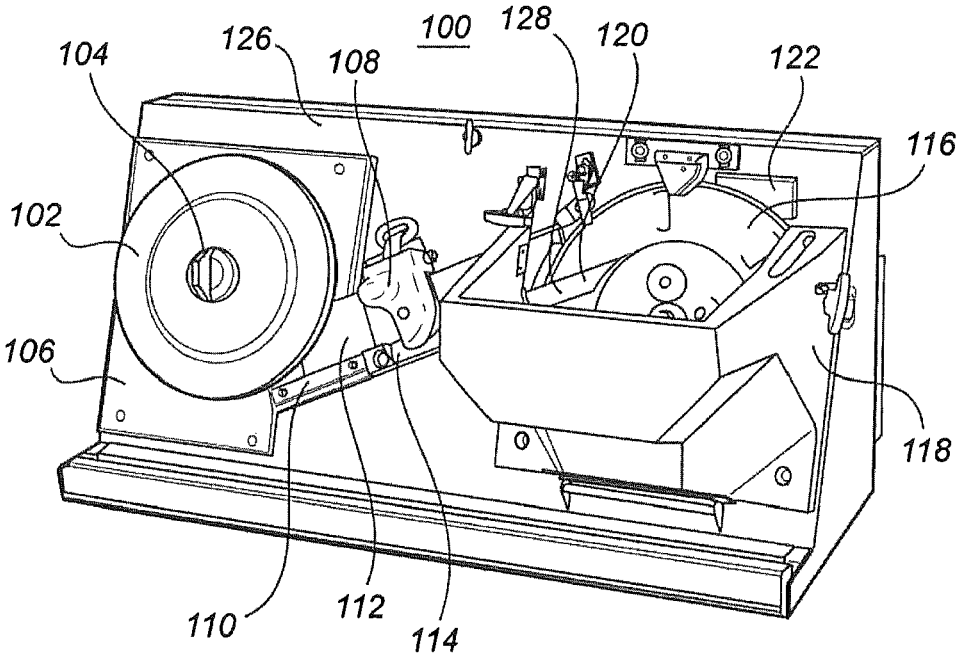
FIG. 1 shows a coin counting and sorting module in accordance with the present disclosure.

FIG. 1 shows by way of example a coin sorting and counting module 100. The coin sorting and counting module 100 comprises a coin sorter 102 mounted on a front plate 126 of coin sorting and counting module 100 by a locking knob 104. The coin sorter 102 comprises a base plate 106 firmly mounted on the front plate 126. The coin sorting and counting module 100 further comprises a coin bowl 118 which is open at its upper portion, for depositing the mass of coins to be sorted. Inside the coin bowl 118 there is provided a rotatable and flexible rubber disc 116 for engaging the coins to be sorted and lifting them up towards a coin separating knife 128 which is arranged in contact with the rubber disc 116. A overfill protection module 122 ensures that not too many coins are deposited in the coin bowl 118 at once.

The coin separating knife 128, one end 120 of which according to the above is arranged in connection with the rubber disc 116, is at a downward inclination and is connected at its second end 114 to an anti bounce block 110 which will be described in greater detail below. The coin separating knife 128 and the anti bounce block 110 are mounted on an inclined rail block 112. A coin brought into contact to the separating knife 128, by the rotation of the rubber disc 116, and thus separated from the mass of coins to be sorted will by the inclination of the separating knife 128 be brought into a rolling downward motion along the upper side of the separating knife, which has been made flat so as to avoid coins from falling off the knife once separated, towards the front coin sensor 108. When the coin is transported the inclined rail block 112 will support the planar surface of the coin while the upper side of the separating knife 128, and later the anti bounce block 110, will support its perimeter. When rolling down the coin separating knife 128, the coin may for different reasons start to bounce. The coin may for example not be completely round, as in the case of for example British 20 and 50 pence coins, or the bouncing movement may originate from when the coin are separated at the coin bowl 118, or for some other reason.

Figure 2:
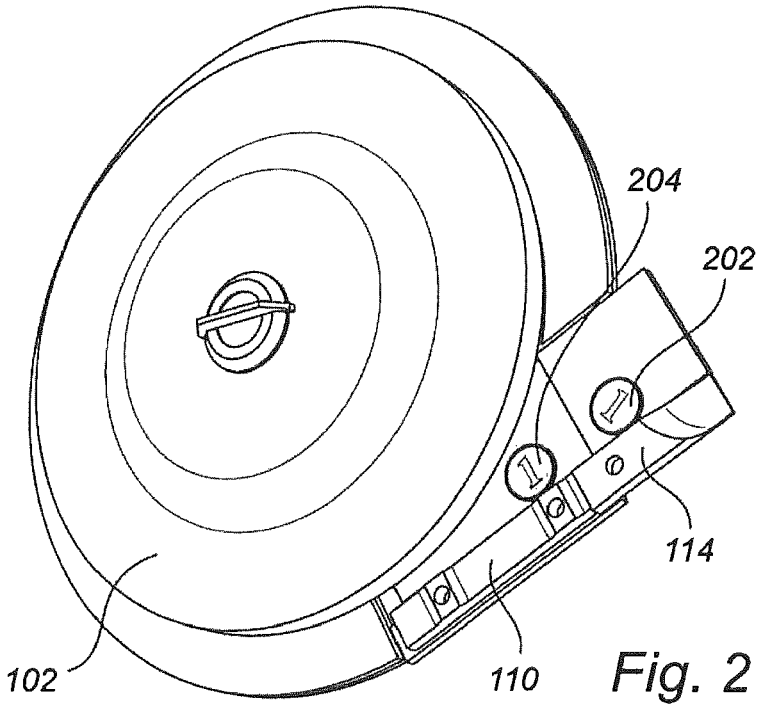
FIG. 2 illustrates how a coin is forwarded to the coin sorter part of a coin counting and sorting module in accordance with the present disclosure.

The functionality of the anti bounce block 110 will now be described in conjunction with FIG. 2. FIG. 2 shows two coins 202, 204 being transported by the inclined rail block 112 to the coin sorter 102. The first coin 204 has just left the second end 114 of the coin separating knife 128 and is now transported by the anti-bounce block 110 and is soon to be engaged by the resilient rim (not shown) of the coin sorter 102. As described above, the transported coins 204, 202 may for different reasons bounce when transported by the inclined rail block 112. If the perimeter of the coin 202, 204 is not in abutment with the anti bounce block 110 when engaged by the resilient rim, miss sorting may occur since its height wise location in relation to the anti bounce block 110 is uncertain. The coin sorter 102 is designed to manage bouncing coins to a certain extent, but if the bouncing amplitude is too high, sorting errors may occur. The coin sorter used in the experimental work of the present application typically manages low bouncing amplitudes around 5-11 mm very well but higher amplitudes may lead to sorting errors. As described above, it may be important that the rim of the coin sorter 102 provides adequate and consistent pressure to the coin 202, 204 to be sorted towards the border of the base plate, and if the coin is bouncing when engaged by the rim, the force by which the rim affects the coin 202, 204 may vary. As can be understood from the above, the bouncing of the coin needs to be reduced.

When trying to solve this problem, the inventors tried a variety of different possible solutions. Some solutions included an anti bounce block which could move up and down in relation to the inclined rail block, to have a damping effect on a bouncing coin. The dampening abilities of such an anti bounce block varied, were hard to control and could in some situations even increase bouncing. The best solutions included an anti bounce block made of metal rigidly mounted on the inclined rail block by a finite number of fastening elements. Surprisingly, an anti bounce block rigidly fastened by a finite number of fastening elements showed much better anti bounce abilities than if the anti bounce block and inclined rail block would be integrated into one integral piece of metal. Hence, the integrated solution was rejected because of its terrible ability to absorb bouncing. In a further tested solution, the anti bounce block was made of a plastic material but the result was not satisfactory. The theoretical explanation to why the chosen design of the anti bounce block showed such satisfactory results is not fully known. According to the theory of the inventors, bouncing energy is absorbed by the anti bounce block mass and transferred away in a beneficial way with this set up.

Figure 7:
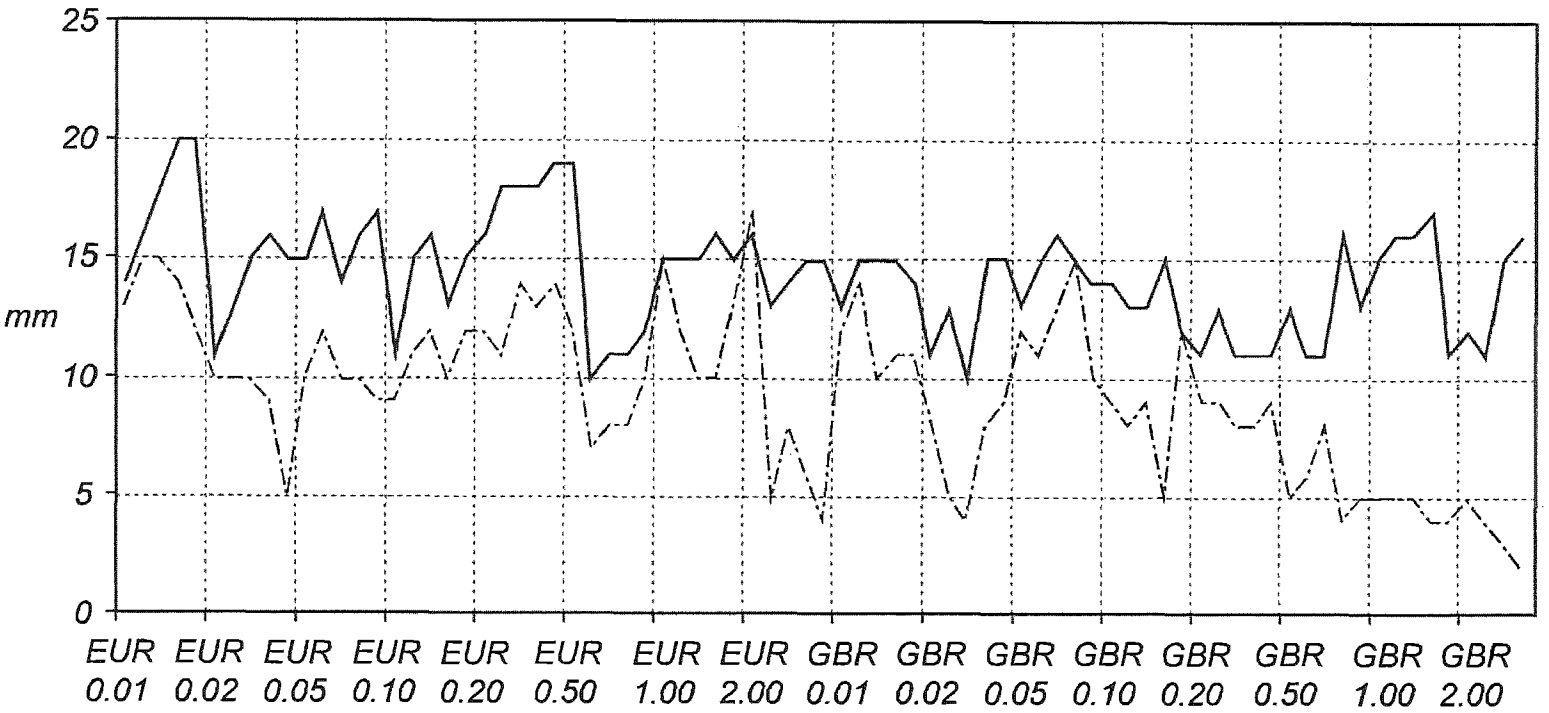
FIG. 7 shows results of a bounce test where coins of different denominations are released from a point above the anti-bounce block. The diagram shows 4-6 bounce examples per coin and the bouncing amplitude in millimeters is given.

Two different designs of the anti bounce block where tested. One design which is explained in detail in conjunction with FIGS. 3 and 4 below and one wedge-shaped design, the wedge-shaped design having its wedge connected at the second end 114 of the separating knife 128. The test was performed by releasing a coin 5-6 times along the length of the anti bounce block. The tests were carried out in the following way: Coins of different denominations were released 50 mm above either a conventional coin rail as is present in the CAM of WO 2008/024043, or one of the two different types of anti-bounce blocks disclosed in the present application. The results for a conventional coin rail (not shown) indicate that many coins, especially of the smaller denominations, showed bouncing amplitudes of more than 20 mm and in some cases even amplitudes up to 25 mm. Table 1, as well as FIG. 7 present results for such tests for anti-bounce blocks according to the present application. The results are expressed as bouncing amplitude in millimeters for different coin types.

Figure 3:
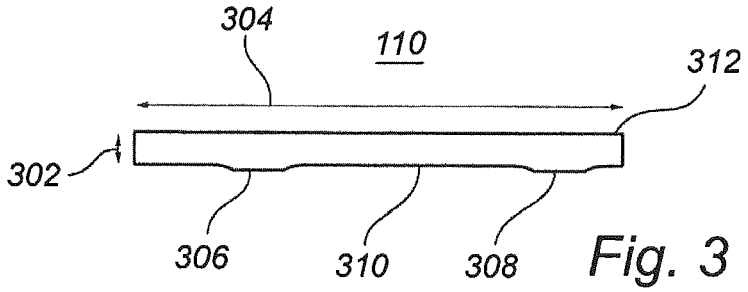
FIG. 3 discloses a side view of an anti-bounce block in accordance with the present disclosure.
Figure 4:
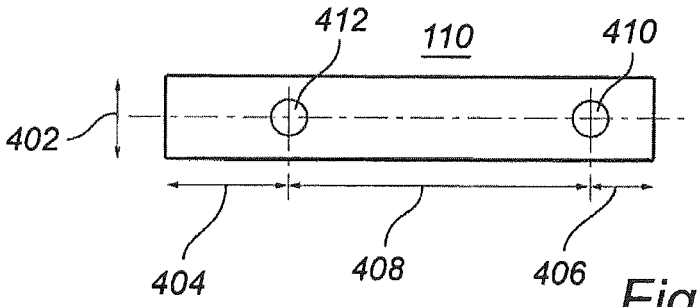
FIG. 4 presents a view from above of an anti-bounce block in accordance with the present disclosure.

As can be seen in FIG. 7, the anti-bounce block (dotted and dashed line) showed in FIGS. 3-4 results in better anti-bounce abilities than the wedge-shaped block (black line). Occasional outliers may be disregarded since this probably is the result of a coin not being released correctly.

It should be pointed out that the bouncing amplitudes obtained in the test are generally larger than amplitudes obtained in a corresponding CAM. The test conditions were selected in order to get high bouncing amplitudes that are easy to measure and to assess. It should be concluded that the rectangular as well as the wedge-shaped anti-bounce block both result in lower bouncing compared to the state-of-the-art solution disclosed in WO 2008/024043.

Moreover, the rectangular anti-bounce block has a lower production cost than the wedge-shaped block.

FIGS. 3-4 illustrate by way of example a side view and a front view, respectively, of an anti bounce block 110 to be mounted on an inclined rail block according to embodiments of the present disclosure. The thickness 302 of the anti bounce block 110 is according to some embodiments 5.7 mm. The length 304 is according to some embodiments 73.5 mm. The bulging part 306, 308 in which screw holes 410, 412 (as seen in FIG. 4) is placed are just exemplary. In further embodiments, the bulging parts 306, 308 are left out, thus leading to a completely straight front side 310 of the anti bounce block 110. As can be understood from above, the anti bounce block is rigidly fastened to the inclined rail block of the counting and sorting machine with the back side 312 of anti bounce block 110 towards the inclined rail block. The anti bounce block 110 is according to this embodiment fastened with screws through the screw holes 412, 410 to the inclined rail block. In further embodiments, the anti bounce block 110 is fastened with other fastening means such as glue or a rivet. FIG. 4 shows a front view of the anti bounce block 110. According to at least one example of some embodiments: the height 402 may be 12.6 mm; the screw holes 410, 412 are centrally placed height wise and may have a diameter of 5.5 mm; the center of the left screw hole 412 may be placed 18.5 mm from the left side of the anti bounce block 110, as depicted by the arrow 404; the center of the right screw hole 410 may be placed 9.5 mm from the right side of the anti bounce block 110, as depicted by the arrow 406; and, consequently, the center of the screw holes 410, 412 may be separated by 45.5 mm, as depicted by the arrow 408. The dimen-

TABLE 1

| Coin | w1 (mm) | w2 (mm) | w3 (mm) | w4 (mm) | w5 (mm) | w6 (mm) | s1 (mm) | s2(mm) | s3(mm) | s4(mm) | s5 (mm) | s6(mm) |
|---|---|---|---|---|---|---|---|---|---|---|---|---|
| EUR 0.01 | 14 | 16 | 18 | 20 | 20 | | 13 | 15 | 15 | 14 | 12 | |
| EUR 0.02 | 11 | 13 | 15 | 16 | 15 | | 10 | 10 | 10 | 9 | 5 | |
| EUR 0.05 | 15 | 17 | 14 | 16 | 17 | | 10 | 12 | 10 | 10 | 9 | |
| EUR 0.10 | 11 | 15 | 16 | 13 | 15 | | 9 | 11 | 12 | 10 | 12 | |
| EUR 0.20 | 16 | 18 | 18 | 18 | 19 | 19 | 12 | 11 | 14 | 13 | 14 | 12 |
| EUR 0.50 | 10 | 11 | 11 | 12 | 15 | 15 | 7 | 8 | 8 | 10 | 15 | 12 |
| EUR 1.00 | 15 | 16 | 15 | 16 | | | 10 | 10 | 13 | 17 | | |
| EUR 2.00 | 13 | 14 | 15 | 15 | | | 5 | 8 | 6 | 4 | | |
| GBP 0.01 | 13 | 15 | 15 | 15 | 14 | | 12 | 14 | 10 | 11 | 11 | |
| GBP 0.02 | 11 | 13 | 10 | 15 | | | 8 | 5 | 4 | 8 | | |
| GBP 0.05 | 15 | 13 | 15 | 16 | 15 | | 9 | 12 | 11 | 13 | 15 | |
| GBP 0.10 | 14 | 14 | 13 | 13 | 15 | | 10 | 9 | 8 | 9 | 5 | |
| GBP 0.20 | 12 | 11 | 13 | 11 | 11 | | 12 | 9 | 9 | 8 | 8 | |
| GBP 0.50 | 11 | 13 | 11 | 11 | 16 | | 9 | 5 | 6 | 8 | 4 | |
| GBP 1.00 | 13 | 15 | 15 | 16 | 17 | | 5 | 5 | 5 | 5 | 4 | |
| GBP 2.00 | 11 | 12 | 11 | 15 | 16 | | 4 | 5 | 4 | 3 | 2 | |

EUR = Euro

GBP = British Pound w = wedge. The letter "w" plus a number relates to different bouncing experiments with a wedge carried out according to the same protocol.

s = straight (the anti bounce block of claim 1). The letter "s" plus a number relates to different bouncing experiments with a straight anti bouncing block carried out according to the same protocol.

sions of the anti bounce block 110 shown in FIGS. 3-4 are just by way of example, other dimensions are possible.

Figure 5:
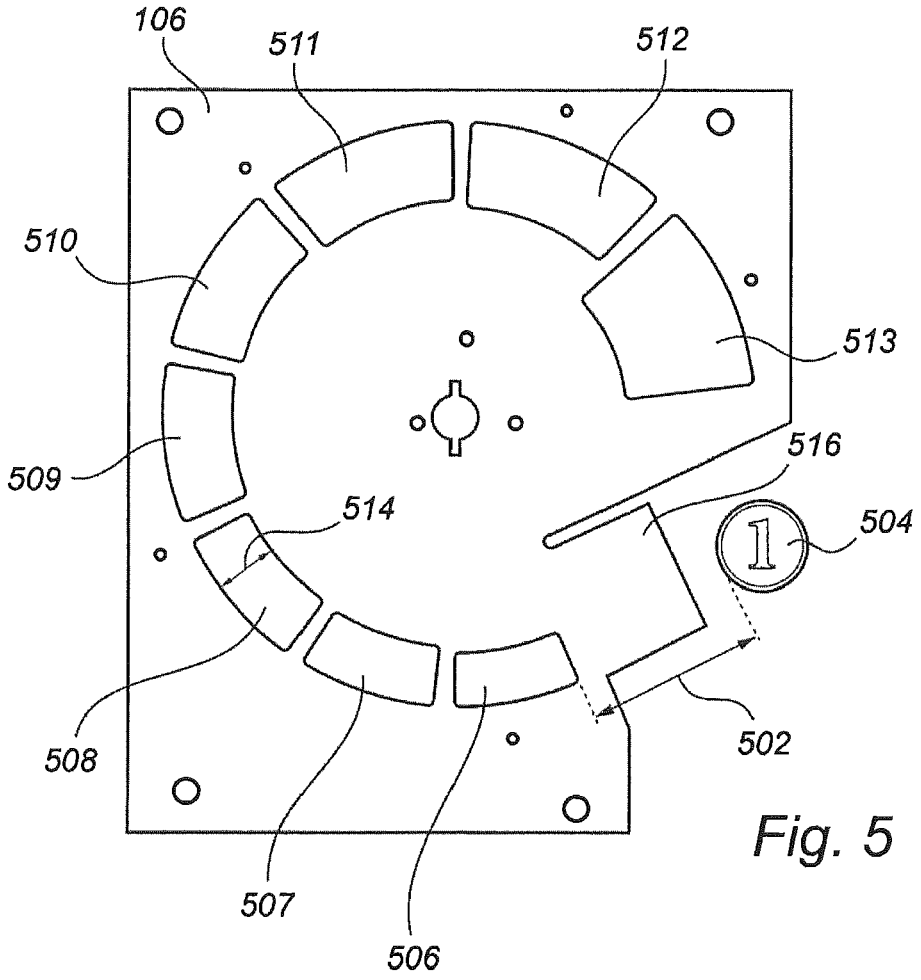
FIG. 5 shows a view from above of a coin entering the coin sorter and the circular sorting path comprising openings having increasing size.
Figure 6:
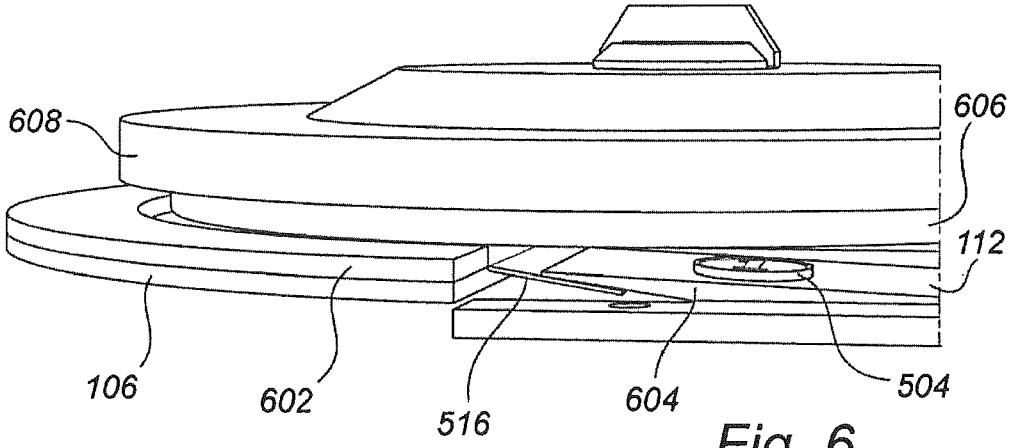
FIG. 6 illustrates a side view of the inclined rail block guiding a coin into the coin sorter.

According to embodiments of the present disclosure, there is provided a coin counting and sorting module 100 wherein the design of the inclined rail block 112 is designed to deliver a transported coin 504 to the coin sorter such that a resilient rim 606 of the coin sorter will engage the coin 504 at least 35 mm from a first coin opening 506 of the base plate 106 of the coin sorter. This feature of such a coin counting and sorting module 100 will be explained in conjunction with FIGS. 5-6. FIG. 5 shows by way of example the base plate 106 of a coin sorter, the base plate comprising a plurality of circularly arranged coin openings 506-513. The count of the coin openings and the form of each coin opening are decided by the currency that this particular coin sorter are set up to sort. As can be seen in FIG. 5, the outer edge of each coin opening 506-513 is placed on the edge of an imaginary circle drawn on the base plate 106 with its center at the center of the base plate 106. When sorting a coin 504, the coin is brought in a path across the plurality of circularly arranged coin openings 506-513 such that the part of the coin furthest away from the center of the base plate 106 will be just outside the edge of the imaginary circle during the entire path. As can be understood, the width 514 of the coin opening 506-513, herein exemplified at the coin opening 508, will decide if the coin will fall into the coin opening 506-513 or pass over it. As mentioned above, it may be important that the resilient rim 606 engages the coin 504 at least 35 mm (depicted by the reference 502) before the first coin opening 506. This can be achieved by providing an angled end portion 604 of the inclined rail block 112, as depicted in FIG. 6. By providing the angled end portion 604 according to embodiments, a small coin, such as a 1 cent Euro coin will be engaged approximately 41 mm from the first coin opening 506. A larger coin, such as the 2 Euro coin will be engaged approximately 57 mm from the first coin opening 506. A very large coin, such as the USD 50 cent will be engaged approximately 63 mm from the first coin opening 506. This measures can be compared to prior art where the angled end portion 604 does not exist, and where the coin instead where transported from the plane of the rail block 112 to the plane of the coin sorter via a bent part 516 of the base plate. According to that embodiment of prior art, the exemplary coins above where engaged between 15-27 mm later. A possible consequence of this is that the resilient rim 606 cannot press the coin 504 towards the border 602 of the base plate 106 fast enough, i.e. before the first coin opening 506, thus the risk of miss sorting is increased. A further advantage of the inventive angled end portion 604 of the inclined rail block 112 over the prior art is that in the prior art the coin 504 was brought in below the rim 606 before it was pushed against the rim and engaged by it. According to this new design of the end part 604 of the inclined rail block 112, the coin is now pushed in from the side. Doing so is faster and enables the grabbing procedure to act over a longer distance.

The present disclosure also provides coin handling apparati (not shown in the figures) comprising a coin counting and sorting module in accordance with the present disclosure. Examples of such coin handling apparati are retail cash systems capable of efficient sorting of a large amount of coins and dispensing of specific amounts of different coin denominations in a cash till. The present module may also be used in coin deposit systems and other systems and apparati involving sorting of coins.

The person skilled in the art realizes that the present invention by no means is limited to the embodiments described above. On the contrary, many modifications and variations are possible within the scope of the appended claims. For example, the design of the coin counting and sorting device described above is just exemplary, other ways of feeding coins to the coin sorter is equally possible.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A coin counting and sorting module comprising:

a coin sorter wherein coins to be sorted are transported by a rotary disc along a circular sorting path across a series of openings of increasing size, said coin sorter having a resilient rim for engaging coins;

a coin bowl for receiving a deposited mass of coins to be sorted, said coin bowl having an inner surface intended to be in contact with the coins to be sorted, the inner surface comprising a rotating surface adapted for being rotated when the module is in operation;

a coin sensor for detecting and removing counterfeit coins; and a coin separating rail knife for receiving coins one by one at a first end thereof from the rotating surface and for guiding the coins past the coin sensor;

characterized in that the coin counting and sorting module also comprises an inclined rail block for receiving accepted coins from a second end of the coin separating rail knife and forwarding these coins to the coin sorter, said inclined rail block having a first rail block end and a second rail block end downstream from the first rail block end; and an anti-bounce block fastened to the inclined rail block proximate the second rail block end, wherein the anti-bounce block is positioned such that the resilient rim may engage an accepted coin while the coin is in abutment with the anti-bounce block.

2. A coin counting and sorting module according to claim 1, characterized in that the anti-bounce block is rectangular in a front view.

3. A coin counting and sorting module according to claim 2, characterized in that the anti-bounce block has a length within the range of 50-100 mm and a height within the range of 5-20 mm.

4. A coin counting and sorting module according to claim 1, characterized in that the inclined rail block has an angled end part adapted for guiding coins one by one from the plane of the coin separating rail knife to the plane of the coin sorter.

5. A coin counting and sorting module according to claim 4, characterized in that the inclination of the angled end part of the inclined rail block amounts to a value comprised within the range from and including 1° up to and including 15° in relation to the plane of the sorting rail knife.

6. A coin counting and sorting module according to claim 1, characterized in that the overall shape of the anti-bounce block is a substantially rectangular parallelepiped.

7. A coin counting and sorting module according to claim 6, characterized in that there are bulging parts on the surface of the anti-bounce block that are adapted to be facing away from the inclined rail block in the vicinity of one or more openings for receiving one or more fastening elements.

8. A coin counting and sorting module according to claim 1, characterized in that the anti-bounce block is substantially wedge-shaped.

9. A coin counting and sorting module according to claim 1, characterized in that the anti-bounce block is made entirely of metal.

10. A coin counting and sorting module according to claim 1, characterized in that the inclined rail block is made entirely of metal.

11. A coin handling apparatus comprising a coin counting and sorting module, which coin counting and sorting module comprises:

a coin sorter wherein coins to be sorted are transported by a rotary disc along a circular sorting path across a series of openings of increasing size, said coin sorter having a resilient rim for engaging coins;

a coin bowl for receiving a deposited mass of coins to be sorted, said coin bowl having an inner surface intended to be in contact with the coins to be sorted, the inner surface comprising a rotating surface adapted for being rotated when the module is in operation;

a coin sensor for detecting and removing counterfeit coins; and a coin separating rail knife for receiving coins one by one at a first end thereof from the rotating surface and for guiding the coins past the coin sensor;

characterized in that the coin counting and sorting module also comprises an inclined rail block for receiving accepted coins from a second end of the coin separating rail knife and forwarding these coins to the coin sorter, said inclined rail block having a first rail block end and a second rail block end downstream from the first rail block end; and an anti-bounce block fastened to the inclined rail block proximate the second rail block end, wherein the anti-bounce block is positioned such that the resilient rim may engage an accepted coin while the coin is in abutment with the anti-bounce block.

12. A coin handling apparatus according to claim 11, wherein the coin counting and sorting module is characterized in that the anti-bounce block is rectangular in a front view.

13. A coin handling apparatus according to claim 12, wherein the coin counting and sorting module is, characterized in that the anti-bounce block has a length within the range of 50-100 mm and a height within the range of 5-20 mm.

14. A coin handling apparatus according to claim 11, wherein the coin counting and sorting module is characterized in that the inclined rail block has an angled end part adapted for guiding coins one by one from the plane of the coin separating rail knife to the plane of the coin sorter.

15. A coin handling apparatus according to claim 14, wherein the coin counting and sorting module is characterized in that the inclination of the angled end part of the inclined rail block amounts to a value comprised within the range from and including 1° up to and including 15° in relation to the plane of the sorting rail knife.

16. A coin handling apparatus according to claim 11, wherein the coin counting and sorting module is characterized in that the overall shape of the anti-bounce block is a substantially rectangular parallelepiped.

17. A coin handling apparatus according to claim 11, wherein the coin counting and sorting module is characterized in that the anti-bounce block is substantially wedge-shaped.

* * * * *